US010653224B2

(12) United States Patent
Steeman et al.

(10) Patent No.: US 10,653,224 B2
(45) Date of Patent: May 19, 2020

(54) HAIR REMOVAL APPARATUS

(71) Applicant: KONINKLIJKE PHILIPS N.V., Eindhoven (NL)

(72) Inventors: Jonne Steeman, Eindhoven (NL); Sebastian Alexander Kindermann, Eindhoven (NL); Michel Van Es, Eindhoven (NL); Marjan Willeke Esther Cornelissen, Eindhoven (NL); Nienke Krop, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/108,894

(22) PCT Filed: Nov. 24, 2015

(86) PCT No.: PCT/EP2015/077400
§ 371 (c)(1),
(2) Date: Jun. 29, 2016

(87) PCT Pub. No.: WO2016/087253
PCT Pub. Date: Jun. 9, 2016

(65) Prior Publication Data

US 2017/0258198 A1 Sep. 14, 2017

(30) Foreign Application Priority Data

Dec. 1, 2014 (EP) ..... 14195567

(51) Int. Cl.
*A45D 26/00* (2006.01)
*B26B 19/42* (2006.01)

(52) U.S. Cl.
CPC ..... *A45D 26/0028* (2013.01); *A45D 26/0061* (2013.01); *B26B 19/42* (2013.01)

(58) Field of Classification Search
CPC ..... A45D 26/0057; A45D 26/0028; A45D 27/38; A45D 26/0033; A45D 26/0071;
(Continued)

(56) References Cited

U.S. PATENT DOCUMENTS 2,726,443 A 12/1955 Miller
3,127,676 A 4/1964 Johnson
(Continued)

FOREIGN PATENT DOCUMENTS

DE 102005061490 A1 7/2007
EP 2462832 A1 * 6/2012 ..... A45D 26/0028
(Continued)

*Primary Examiner* — Kathleen S Holwerda
*Assistant Examiner* — Brooke Labranche

(57) ABSTRACT

The present invention relates to hair removal, and in particular to a handheld hair removal apparatus. In order to reduce pain during hair removal, the handheld hair removal apparatus comprises a hair removal arrangement, a support structure and a skin stretching device attached to the support structure and comprising at least two leading surface portions for skin contacting and stretching. The apparatus has a main movement direction in which the apparatus is to be moved relative to skin during use. The hair removal arrangement comprises a skin contact portion for contacting a user's skin during operation, wherein the skin contact portion extends at least along a primary axis extending perpendicularly to the main movement direction During operation, the skin stretching device provides a stretched skin portion between the at least two leading surface portions.

17 Claims, 5 Drawing Sheets

(58) Field of Classification Search
CPC ..... A45D 27/00; B26B 19/42; B26B 19/46; B26B 19/38; B26B 19/16; B26B 21/00
See application file for complete search history.

(56) References Cited

U.S. PATENT DOCUMENTS

| | | | | |
|---|---|---|---|---|
| 3,992,775 | A * | 11/1976 | De Vries | B26B 19/14 30/34.2 |
| 6,568,081 | B2 * | 5/2003 | Barish | B26B 19/14 30/34.2 |
| 8,367,974 | B2 | 2/2013 | Azar | |
| 8,377,078 | B2 * | 2/2013 | Kindermann | A45D 26/0028 606/133 |
| 9,814,292 | B2 * | 11/2017 | Tittas | A45D 26/0061 |
| 2008/0301947 | A1 | 12/2008 | Dorber | |
| 2015/0128776 | A1 | 5/2015 | Zuidervaart | |
| 2016/0143410 | A1 * | 5/2016 | Stampe | B26B 19/46 606/133 |

FOREIGN PATENT DOCUMENTS

| | | | |
|---|---|---|---|
| EP | 2462832 | A1 | 6/2012 |
| FR | 2802393 | A1 | 6/2001 |
| JP | 03193003 | A | 8/1991 |
| JP | 2001286327 | A | 10/2001 |
| WO | 0200058 | A1 | 1/2002 |
| WO | 2005002386 | A1 | 1/2005 |
| WO | 2006063370 | A1 | 6/2006 |
| WO | 2009104124 | A2 | 8/2009 |
| WO | 2009150607 | A2 | 12/2009 |

* cited by examiner

HAIR REMOVAL APPARATUS

This application is the U.S. National Phase application under 35 U.S.C. § 371 of International Application No. PCT/EP2015/077400, filed on Nov. 24, 2015, which claims the benefit of International Application No. 14195567.4 filed on Dec. 1, 2014. These applications are hereby incorporated by reference herein.

FIELD OF THE INVENTION

The present invention relates to hair removal, and in particular to a handheld hair removal apparatus.

BACKGROUND OF THE INVENTION

It is known to remove hair on body surfaces like skin portions of the arms or legs, for example. For such hair removal, handheld, motor-driven devices are used. For example, motor-driven epilators or shavers are widely used. However, epilating can be a procedure in which a user may experience pain. In WO 2009/150607 A2, a stimulation to the skin immediately before hairs are extracted from the skin (or after the removal of hair) is provided in the form of an epilator having a massage roller. The massage roller comprises pairs of elementary massaging members positioned in a V-shape relative to each other. As a further example, WO 2009/104124 A2 describes an epilator with interchangeable caps, which are coupled to a driving means of the epilator for vibrating, such that a user of the epilator experiences a vibration on the skin. The vibration may cause the skin to be at least partially anaesthetized before the hairs are epilated. As a further example, for moving the shear head of a shaver more smoothly over the surface of the skin, U.S. Pat. No. 3,127,675 describes a skin stretcher that is mounted parallel to the shear head. An adjustable gap is provided between a skin abutting portion of the stretcher and the shaving head. The edge of the skin stretcher defines the shape of the gap, which allows adjusting how much the skin is to be stretched; for example, by adapting the gap so as to be wider in the middle, less skin tension in the middle of the skin stretcher is achieved. However, it has been shown that during hair removal, pain may still be experienced to a rather unpleasant degree.

SUMMARY OF THE INVENTION

There may thus be a need to further facilitate hair removal and increase user friendliness.

The object of the present invention is achieved by the subject-matter of the independent claims, wherein further embodiments are incorporated in the dependent claims.

According to a first aspect of the present invention, a handheld hair removal apparatus is provided that comprises a main movement direction in which the apparatus is to be moved relative to skin during use, and that comprises a hair removal arrangement comprising a skin contact portion for contacting a user's skin during operation, a support structure for supporting the hair removal arrangement, and a skin stretching device. Said skin contact portion extends at least along a primary axis extending perpendicularly to the main movement direction. The skin stretching device is attached to the support structure and comprises at least two leading surface portions for contacting and stretching the skin. The at least two leading surface portions are each provided with a skin touching surface portion. The at least two leading surface portions, seen in an imaginary plane comprising a base line and extending parallel to the main movement direction, are arranged at opposite inclinations of at least 20° with the base line, wherein the base line is a line perpendicular to the main movement direction and parallel to the primary axis. Each of the skin touching surface portions, seen in said imaginary plane, has a main direction of extension that is inclined with respect to the base line at an angle of at least 20°. In the main movement direction, the leading surface portions are oriented towards each other. In an operational position, the skin stretching device is arranged in front of the skin contact portion with respect to the main movement direction. The at least two leading surface portions are configured and arranged to be brought into contact with the skin, during operation, to act on the skin with a pushing force having a first vector, parallel to the skin's surface, in a first direction parallel to the main movement direction, and a second vector, parallel to the skin's surface, in a second direction perpendicular to the main movement direction.

Advantageously, the skin stretcher decreases the degree of skin doming and tightens the skin at the position of the hair removal process. The reduced degree of skin doming also reduces the friction on the skin by the hair removal arrangement, which comprises for example a rotating epilating cylinder of an epilator or shaving or trimming blades. As a further benefit, the skin stretcher lifts flat lying hairs that are difficult to catch in the hair removal process.

The leading surface portions relate to a portion of the skin stretching device that is the first portion that comes into contact with the skin when the apparatus is moved over the skin in the main movement direction during operation.

The leading surface portions can also be referred to as skin contacting and stretching portions.

During operation, the skin stretching device provides a stretched skin portion between the at least two leading surface portions.

Advantageously, the skin is stretched in both the main movement direction of the hair removal device and in a direction perpendicular to the main movement direction of the hair removal device. The stretching of the skin in the main movement direction is achieved by pushing the skin forward in the main movement direction by means of the two leading surface portions, and also, at least to a certain degree, as a result of the friction between the skin stretching device and the skin. The stretching of the skin in the direction perpendicular to the main movement direction is achieved as a result of the inclined arrangement of the leading surface portions, which inclined arrangement causes the skin to be pushed aside relative to the main movement direction.

The pushing force thus has two vectors or components. The pushing force could therefore also be referred to as a two-vector pushing force, or a pushing force with components in two different directions. The pushing force thus provides bi-directional stretching. The skin stretching device, consequently, is a bi-directional skin stretching device.

In an example, the inclination of the leading surface portions relative to the base line is at least 30°, more preferably at least 45°. The leading surface portions may form a front portion or bow-portion at a location where they meet at an angle of 120° or smaller, e.g. 90°.

In an example, the skin contact portion has a geometrical extension, e.g. a rounded skin contact portion in case of a round, e.g. circular, shaving head.

According to an example, the at least two leading surface portions each extend from the support structure so as to form at least part of a bow-shaped structure.

The term "bow" relates to a form where the height of the bow, i.e. the extension of the bow from the base line, is at least a quarter of the length of the base line.

According to an example, the at least two leading surface portions are provided so as to jointly form a bow-shaped structure with an open front portion.

In other words, the bow is a virtual bow, since the front part is not formed by the leading surface portions.

In an example, the at least two leading surface portions are provided as a bow-shaped structure with a closed front portion.

A bow-shaped structure has the advantage that it provides the pushing force with a first and a second vector.

According to an example, the at least two leading surface portions are provided with a convex structure with respect to their outer shape facing forward in the main movement direction.

Advantageously, the skin surface is pushed in the forward direction and also sideways in a manner improving the user comfort experience.

According to an example, a magnitude of the second vector of the pushing force is at least 25% of a magnitude of the first vector of the pushing force. As a result, the at least two leading surface portions provide a degree of stretching of the skin in a direction perpendicular to the main movement direction which is at least 25% of a degree of stretching of the skin in the main movement direction.

According to an example, the magnitude of the second vector of the pushing force is larger than the magnitude of the first vector of the pushing force, so that the degree of stretching of the skin in the direction perpendicular to the main movement direction is larger than the degree of stretching of the skin in the main movement direction.

Stretching the skin more in the direction perpendicular to the main movement direction, i.e. sidewards, allows an even further facilitated and improved hair removal.

According to an example, the hair-removal arrangement comprises a hair removal component with a longitudinal axis extending perpendicularly to the main movement direction. The hair removal apparatus is an epilator or a shaver. If it is an epilator, the hair removal component is an epilating cylinder which is rotatable about the longitudinal axis and which has a number of hair clamping members for catching and clamping hairs and pulling them out of the skin. If the hair removal apparatus is a shaver, the hair removal component is a shaving head with at least one hair cutting member.

In another example, the hair removal arrangement comprises a hair removal component with a round shape. For example, the round hair removal component is a round shaving head.

According to an example, viewed in a direction parallel to the primary axis, the hair removal arrangement has a first length and the at least two leading surface portions each have a second length which is at least 20% of said first length of the hair removal arrangement. In this example, the expression "length" means a distance over which the hair removal arrangement and the leading surface portions respectively extend in a direction parallel to the primary axis, which corresponds to a distance between two ultimate positions on, respectively, the hair removal arrangement and the leading surface portions seen in the direction parallel to the primary axis. Because in this example the leading surface portions each extend over a length parallel to the primary axis which is at least 20% of the length over which the hair removal arrangement extends parallel to the primary axis, the two leading surface portions provide their skin stretching effects to a substantial part of the skin surface which is in front of the hair removal arrangement during operation.

In a hair removal procedure by means of the apparatus according to the invention, a handheld hair removal apparatus according to one of the above-mentioned examples is moved along a skin surface with hairs to be removed. As a result, a portion of the skin is stretched by means of the skin stretching device. The hairs are then removed from the stretched skin portion. Advantageously, the hairs can be removed from the stretched skin portion with less pain, so that the hair removal is facilitated.

These and other aspects of the present invention are apparent from and will be elucidated with reference to the embodiments described hereinafter.

BRIEF DESCRIPTION OF THE DRAWINGS

Exemplary embodiments of the invention will be described in the following with reference to the following drawings.

DETAILED DESCRIPTION OF EMBODIMENTS

Figure 1:
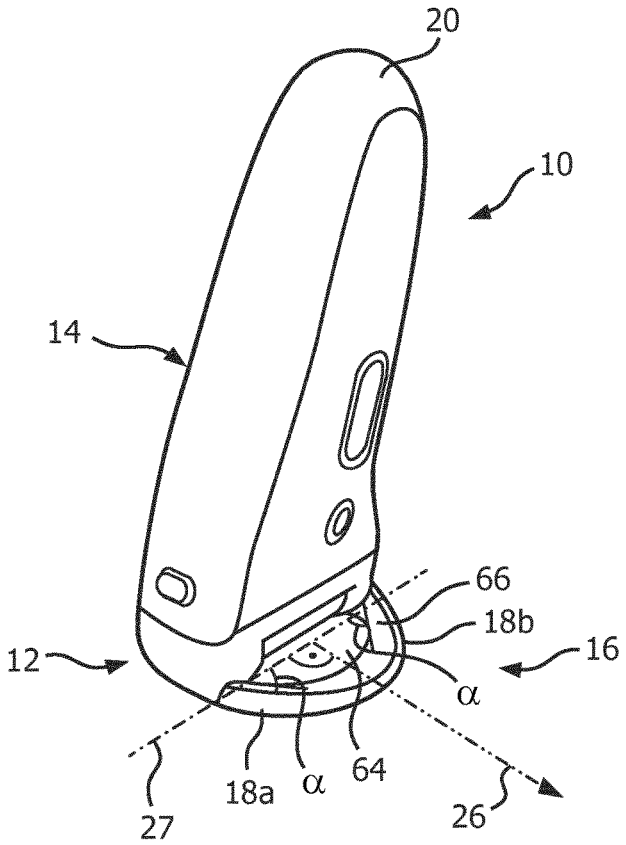
FIG. 1 shows a perspective schematic illustration of an example of a handheld hair removal apparatus according to the invention.

FIG. 1 shows a handheld hair removal apparatus 10 that comprises a hair removal arrangement 12 (further shown in FIGS. 3 and 4), a support structure 14 (not further shown in detail) for supporting the hair removal arrangement and a skin stretching device 16 that is attached to the support structure 14 and that comprises at least two leading surface portions 18*a* and 18*b*. In FIG. 1, the hair removal apparatus 10 is shown in a standing position on a surface, similar to an arrangement during operation.

Figure 3:
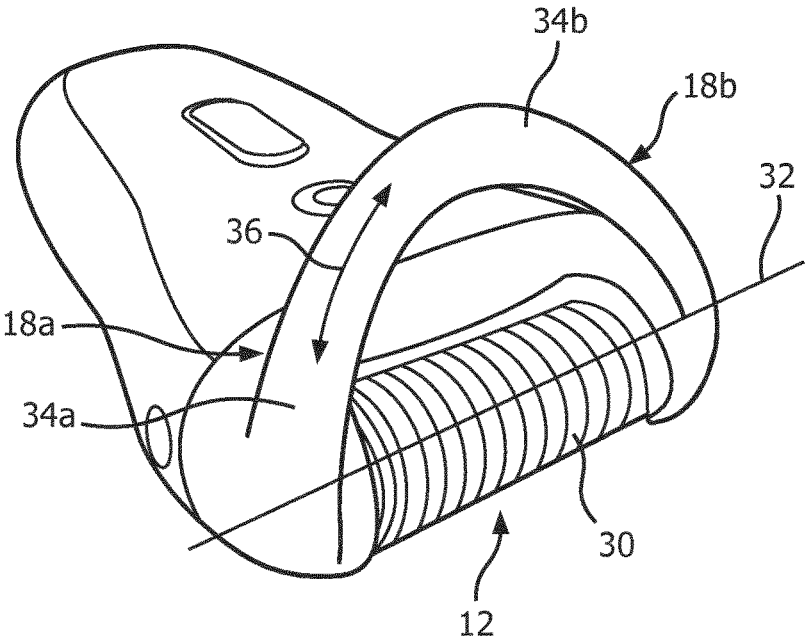
FIG. 3 shows a still further perspective illustration of the apparatus of FIGS. 1 and 2.

Referring to FIG. 3, the hair removal arrangement 12 comprises a skin contact portion 30 for contacting a user's skin during operation. The skin contact portion 30 extends at least along a primary axis 32 extending perpendicularly to a main movement direction 26 (shown in FIG. 1) in which the apparatus 10 is to be moved relative to skin during use. It is noted that the primary axis 32 is perpendicular to the plane of the drawing of FIG. 7, i.e. perpendicular to the plane of paper sheet.

Seen in an imaginary plane extending parallel to the main movement direction 26 and comprising a base line 27, the at least two leading surface portions are arranged at an opposite angle of inclination a of at least 20° with the base line 27, wherein the base line is a line perpendicular to the main movement direction 26 of the apparatus and parallel to a primary axis 32 of the skin contact portion 30 of the hair removal arrangement 12. In FIG. 1, wherein the axis of the main movement direction 26 crosses the base line 27, said imaginary plane is a plane extending through the base line 27 and the axis of the main movement direction 26. As shown in FIG. 1, the angle of inclination a is present in said imaginary plane. Further, in the main movement direction 26, the leading surface portions are oriented towards each other. Still further, in an operational position, the skin stretching device is arranged such that it is in front of the skin contact portion with respect to the main movement direction.

The leading surface portions push the skin forward in the main movement direction in a manner such that the skin in front of the apparatus is stretched.

The hair removal apparatus 10 is a handheld apparatus for mechanically removing body hair on human skin. The hair removal device may be an electrical domestic appliance for personal use. The hair removal device may also be an electrical appliance for professional use, such as in professional hair removal studios or other facilities.

In an example, as shown in the figures, the apparatus is an epilator.

In a further example, although not further shown in the drawings, the apparatus is a shaver and/or a trimmer.

The term "body hair" relates to hair on surfaces of the human body. The body hair is thus differentiated from head hair. The intended use of the hair removal apparatus is primarily the removal of body hair, although head hair can at least theoretically also be removed by the apparatus.

The "support structure", also referred to as body structure, relates to a supporting structure to which the different components of the apparatus are attached. The support structure 14 may be provided as a separate structure which is at least partly enclosed by a housing structure 20, as shown in the figures. The support structure 14 may be provided as one structural element or as several structural pieces or elements that are physically, directly or indirectly, linked to each other.

The support structure 14 may be provided as an elongate support or body structure. The term "elongate" relates to a structure having a dominant longitudinal extension, i.e. an extension in one direction being larger than in a direction transverse thereto. The support structure 14 may have a longitudinal form with an ergonomically suitable shape. The term "ergonomically suitable" relates to a shape that is adapted for handheld operation by the user, preferably for single-hand operation.

The support structure 14 may be arranged as a grip portion or handle portion of the apparatus, i.e. a portion that can be grasped by the hand of a user for manual operation of the apparatus. The term "manual operation" relates to the manual guiding of the apparatus, not to the procedure of removing hair, which may be performed mechanically, for example battery-operated.

The grip portion 20 is provided for holding the apparatus. The grip portion 20 is connected to the body structure and provided along the apparatus to manually move the apparatus relative to the skin in the main movement direction and to manually press the apparatus against the skin.

The "grip portion" relates to an area of the apparatus that can be used by the user to manually hold the hair removal apparatus. The grip portion can be a part of a housing with a separate grip surface, such as a surface covered with a rubber portion or other suitable material providing a stable handhold and also a suitable manual feeling during the operation of the apparatus.

The term "along" relates to an arrangement on the outer surface of the apparatus, such as in the middle portion of an outer housing surface area, or at an end of the apparatus opposite to the end at which the hair removing device is provided. The "end" of the body structure relates to an end portion, or end area, of the apparatus, such as the shorter ends or faces of an elongate structure.

Figure 2:
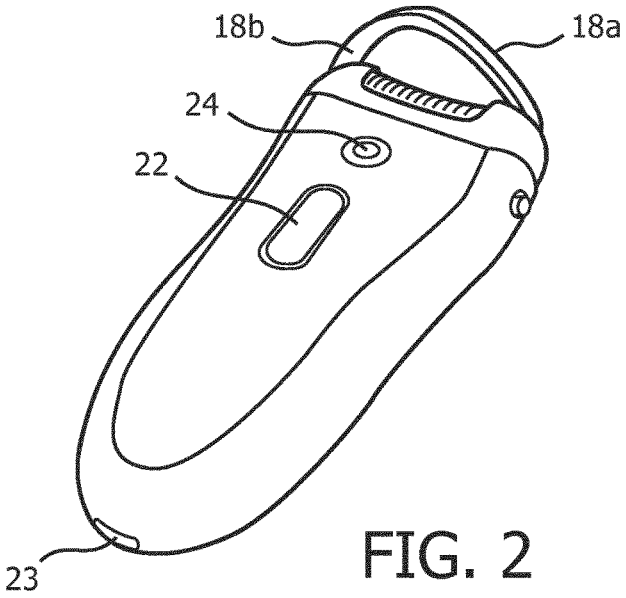
FIG. 2 shows a further perspective illustration of the apparatus of FIG. 1.

Further, as indicated in FIG. 2, a control switch 22 may be provided, and may be supplemented with a control or operation light 24. Further, a socket 23 for connecting a power cable may be provided, e.g. for charging a chargeable battery integrated in the device.

Figure 7:
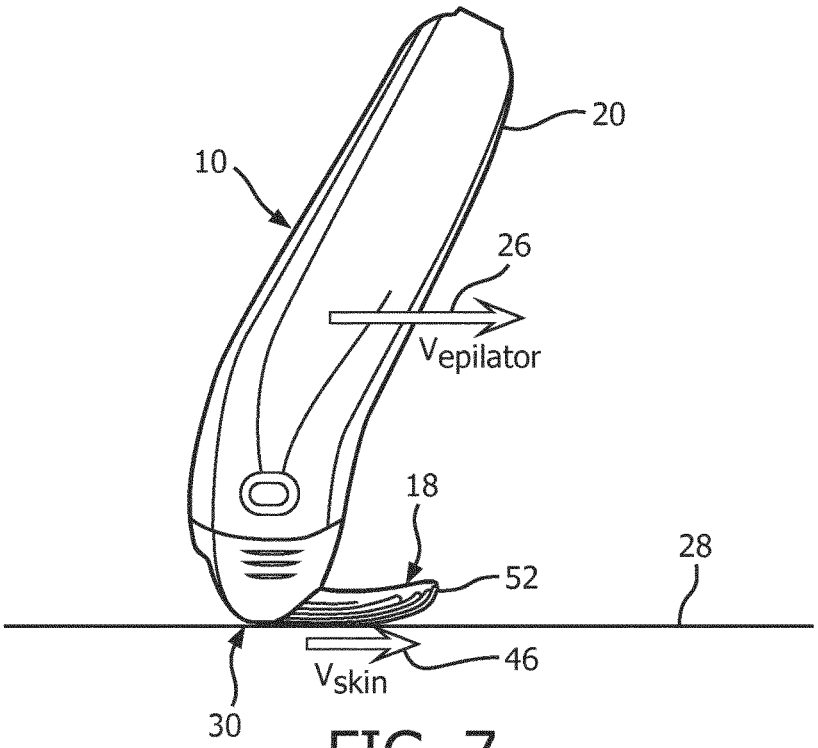
FIG. 7 shows a schematic illustration of aspects during operation of a handheld hair removal apparatus according to the invention.

Now, referring to FIG. 7, during operation, a main movement direction 26 of the apparatus 10 is provided. It is noted that the main movement direction 26 is provided in relation to, for example, a skin portion 28 from which hair has to be removed.

In the absence of perpendicular stretching, the skin is stretched in the longitudinal direction by moving the epilator forward, such that said pushing forward of the epilator and the associated friction cause the skin to move along with the epilator at a fraction 1/x of the epilator's velocity $V_{epilator}$. As a consequence, $V_{skin}=V_{epilator}/x$. The value of x depends on the stroke; initially, the skin will move along at the same speed, i.e., x=1. Yet, because the skin is attached to the surrounding skin, it cannot be pushed along indefinitely. The value of x will increase rapidly until x>1, and for every centimetre the epilator moves, a centimetre of skin passes under the structure. In case of relatively loose skin, the skin stretcher will hop over the bow wave in front of the skin stretcher. In the case of perpendicular stretching, however, the skin is not pushed forward by the skin stretcher, but mainly to the sides.

With respect to epilating, by stretching the skin, the skin becomes more taut, so that skin doming is reduced when hairs are pulled by the disks, thus inflicting less pain. Friction on the skin by the disks is also reduced, due to a reduced contact area. In case of a shaver, the stretcher can also prevent skin damage by the trimmer teeth tips and prevent skin doming in-between the trimmer teeth, foils and lamellae.

The at least two leading surface portions 18*a*, 18*b* are each provided with a skin touching surface portion 34, indicated as 34*a* and 34*b*. Seen in the imaginary plane extending parallel to the main movement direction 26 and comprising the base line 27, the skin touching surface portion 34 has a main direction of extension, indicated by means of a double arrow 36 for one of the two skin touching surface portions 34*a* arranged at an angle of inclination of at least 20° with the base line extending parallel to the primary axis 32.

In an example, shown as an option in the figures, the at least two leading surface portions 18*a*, 18*b* extend from the support structure as at least a part of a bow-shaped structure 50.

In a further example, the at least two leading surface portions 18*a*, 18*b* are provided as a bow-shaped structure 50 with an open front portion.

In a still further example, the at least two leading surface portions 18*a*, 18*b* are provided as a bow-shaped structure with a closed front portion.

Figure 4:
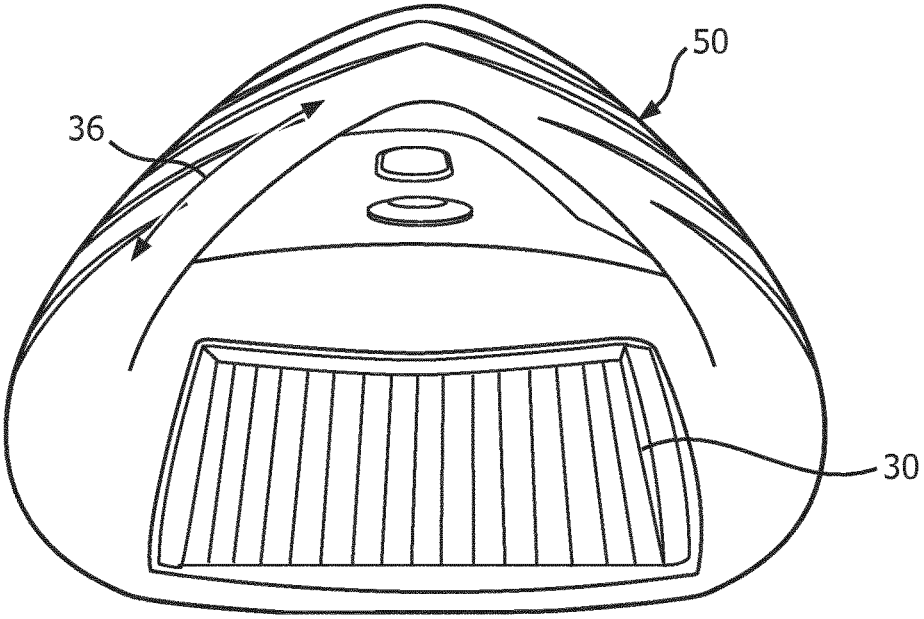
FIG. 4 shows a schematic illustration of the apparatus of FIGS. 1 to 3, showing a hair removal mechanism and a skin stretching device.

In an example, the leading surface portions are provided as a sharp bow structure, for example shown in FIG. 4. In another example, the leading surface portions are provided as a blunt bow structure. Said bow-shaped structure relates to a structure having the form of a bow, such as a semi-circular geometry, or a parabola, or a hyperbolic shape. The bow-shaped structure may also relate to a V-shaped bow (not further indicated), which can comprise semi-circular arms in the form of a V-shape. The V-shaped bow can also comprise linear arms in the form of a V-shape. In a further example, the arms of the V-shape are provided as a combination, or as a free geometrical form, as long as, during operation, the pushing force acting on the skin can be generated.

FIG. 4 shows the hair removal apparatus 10 from below (with respect to the standing arrangement of FIG. 1), i.e. FIG. 4 shows the hair removal apparatus 10 as seen from the skin onto which the apparatus is placed.

Figure 6A:
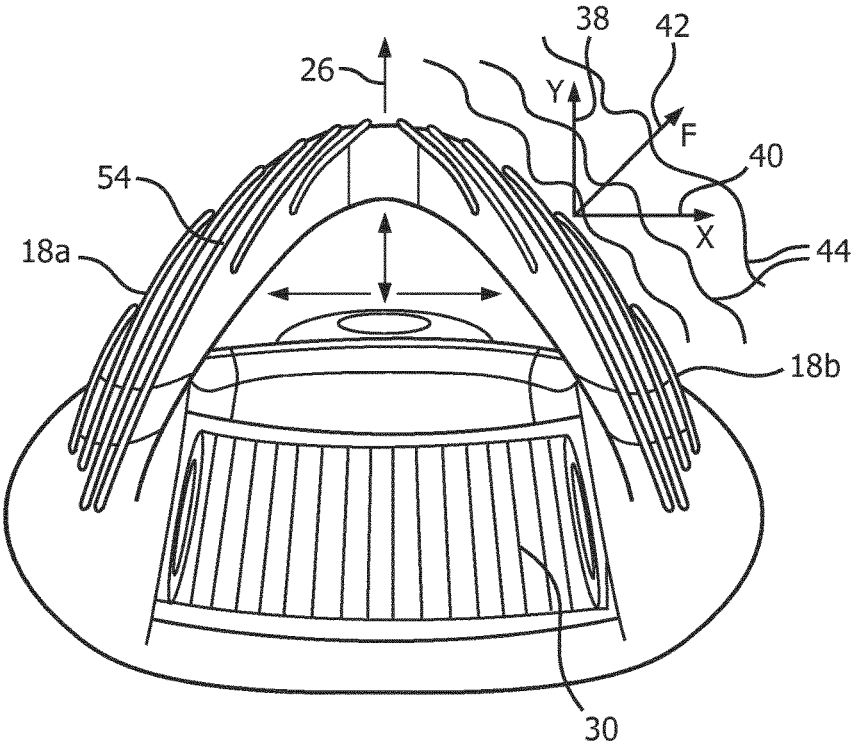
FIG. 6A shows a detail of a skin stretching device in a first example.
Figure 6B:
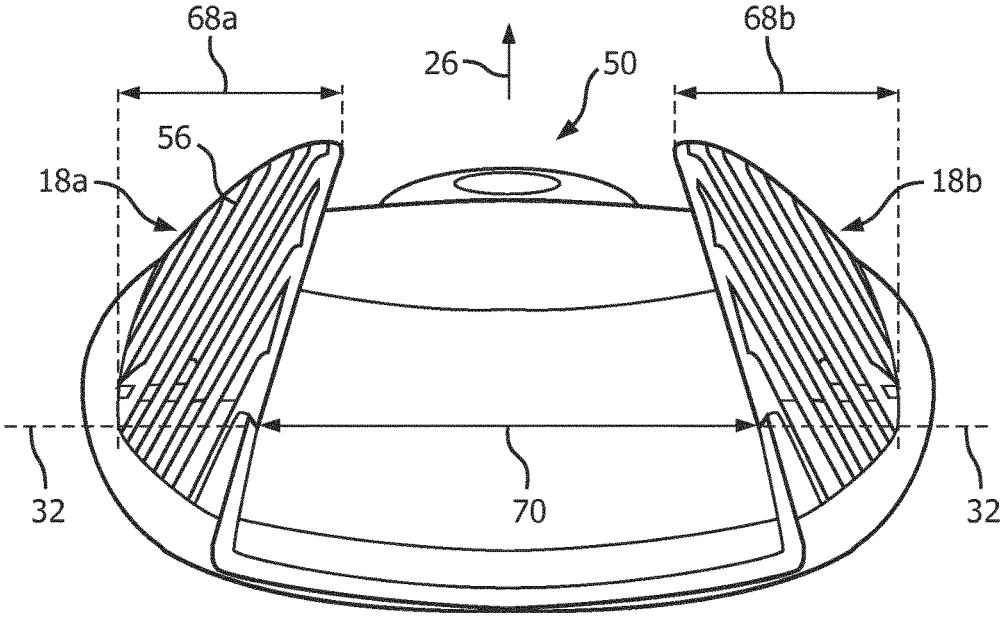
FIG. 6B shows a detail of a skin stretching device in a second example.

In an example, the at least two leading surface portions are provided having an open V-shape as shown in FIG. 6B. It is noted that in FIG. 6B, the epilating cylinder is not shown.

In another example, the at least two leading surface portions are provided as a closed V-shaped bow, for example shown in FIG. 6A.

In an example, the at least two leading surface portions are provided as a single-piece contacting and stretching element, i.e. the at least two leading surface portions are provided on the single-piece contacting and stretching element.

Figure 5:
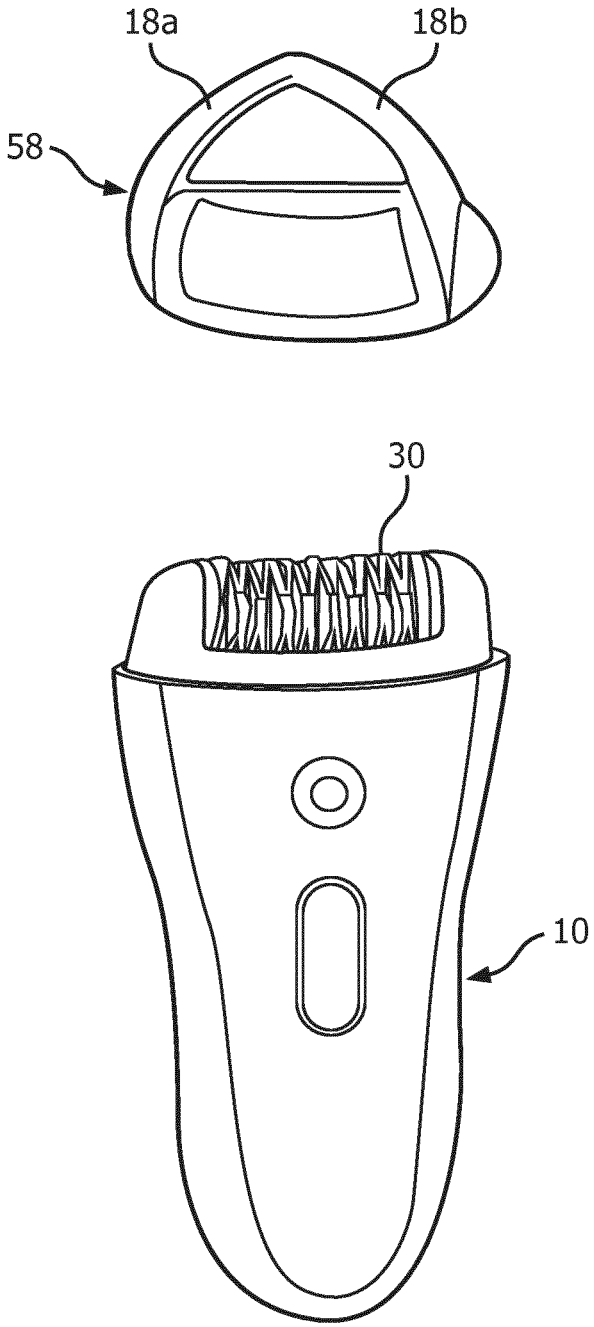
FIG. 5 shows a demounted skin stretching device next to a handheld hair removal apparatus according to the invention.

In an example, the hair-removal arrangement is provided in a head portion of the apparatus, as indicated in FIG. 5. The at least two leading surface portions 18 are provided extending from the head portion in the forward direction with respect to the main movement direction 26.

In an example, the at least two leading surface portions are provided in the form of a fore part of a hull of a boat, i.e. in the form of a bow. The longitudinal axis of the boat (i.e. the direction equal to the boat's straight forward direction) would then be aligned with the main movement direction.

In an example, three or more contacting and stretching portions are provided, such as four, five or six or more (not further indicated).

In a further example, shown as an option in the figures, the at least two leading surface portions 18 are provided with a convex structure with respect to their outer shape, facing forward in the main movement direction 26.

As indicated in FIG. 5, in an example, the at least two leading surface portions are attached to the support structure in a movable manner, allowing relative movement of the at least two leading surface portions with respect to the support structure at least in a direction of the skin contact pressure. The movable manner allows at least a small degree of bending, e.g. 5°, 10° or 15°.

According to a further example, i.e. as an option, the skin stretching device is detachably attached to the support structure. Preferably, a plurality of skin stretching devices are provided that can be detachably mounted to the support structure. The plurality of skin stretching devices provided differ in at least one of: size, shape and material.

In an example, the skin stretching device can be temporarily demounted. In a further example, the skin stretching device can be moved between a stretching position and a hold or pause position, in which the skin is no longer contacted or stretched. This can be achieved, for example, by a sliding support on the support structure or by a pivoting support (not further shown).

In an example, a clipping arrangement is provided for temporarily attaching one of the different skin stretching devices.

In a further example, shown as an option in FIG. 5, a cap 58 is provided that can be attached to the support structure or the housing structure. The at least two leading surface portions are mounted to the cap. The cap may be detachable, as indicated in FIG. 5.

According to the invention, during operation, the at least two leading surface portions 18*a*, 18*b* are brought into contact with the skin to act on the skin with a pushing force 42 having a first vector 38, parallel to the skin surface, in a first direction Y, which first direction Y is parallel to the main movement direction 26. The pushing force 42 also has a second vector 40, also parallel to the skin's surface, in a second direction X perpendicular to the main movement direction 26. The (effective) pushing force is further illustrated in FIG. 6A. However, it is noted that the respective illustration of the pushing force is also applicable for the other embodiments, in particular the example shown in FIG. 6B.

As indicated in FIG. 6A, the pushing force 42 thus acts as a resulting force, also referred to as resulting force F.

As indicated above, in an operational position, the skin stretching device 16 is arranged in front of the skin contact portion 30, as indicated in FIG. 7, with respect to the main movement direction 26. During operation, the skin stretching device provides a stretched skin portion between the at least two leading surface portions 18*a*, 18*b*.

According to the invention, each of the skin touching surface portions 34*a*, 34*b*, seen in an imaginary plane comprising the base line 27 and extending parallel to the main movement direction 26, has a main direction of extension that is inclined to the primary axis 32 and the base line extending parallel to the primary axis and, as a result, inclined to the main movement direction 26.

The skin touching surface portions may also be referred to as skin abutting surface portions.

The term "inclined" relates to a transverse arrangement, i.e. an arrangement that is neither aligned (i.e. neither parallel) with the main movement direction, nor perpendicular to the main movement direction, or that is neither perpendicular to the primary axis, nor aligned (i.e. neither parallel) with the primary axis.

As indicated above, the term "hair removal arrangement", also referred to as hair removing device, relates to a device that removes body hair, e.g. by cutting, trimming or epilating. In case of the apparatus being an epilator, as schematically illustrated in the figures by way of example only, the hair removal arrangement 12 is an epilating device. For example, the epilating device is an epilating cylinder which is rotatable about a longitudinal axis, extending parallel to the primary axis 32, and which has a number of hair clamping members for catching and clamping hairs and pulling them out of the skin, as is also shown in FIG. 3.

In case of the apparatus being a shaver or trimmer, the hair-removal arrangement is a shaving or trimming device. For example, the shaving or trimming device can be a trimming or shaving head with at least one hair cutting member.

The "main movement direction", also referred to as primary hair removal or hair removing direction, relates to a direction in which the apparatus is to be moved in relation to the portion of the skin on which the hair that needs to be removed by the apparatus is present. The main movement direction thus is a relative direction. In an example, the hair removal arrangement together with the gripping portion defines the main movement direction. In other words, the main movement direction is defined by the hair removal arrangement itself and corresponds to a direction in which the user has to move the apparatus relative to skin for a normal, prescribed or optimum operation. For example, the hair removal arrangement may have a linear axis or elongate shape, i.e. with a longitudinal extension, such that a main movement direction will be perpendicular to the linear axis or longitudinal extension. For example, the main movement direction is perpendicular to the longitudinal extension. This provides a maximum coverage during the hair removal operation.

During the operation, as indicated in FIG. 7, the apparatus is moved at a relative movement speed $V_{epilator}$, or more generally the apparatus is moved in the main movement direction 26. Due to the pushing action and also the friction of the leading surface portions 18, a relative movement 46 or $V_{skin}$ is provided to the user's skin due to a frictional movement along the surface, i.e. along the skin 28, having, however, a sideward oriented vector component.

In FIG. 6A, a resulting structure of the skin is indicated by means of schematic lines for ripples 44 of the skin. The arrangement of the ripples 44 of the skin reflect that the skin is pushed in the direction of pushing force 42, i.e. resulting force F.

In a further example, also indicated as an option in the figures, the at least two leading surface portions 18 are provided with a surface structure that is provided with a raised front portion 52, as indicated in FIG. 7, with respect to the main movement direction 26. In an example, the front portions are provided as a distal tip portion extending along approximately 5% of the extension of the leading surface portions, or along 10%, or 15%, or 20%, or 25%, or 30%, or 40%, or 50%, or any value in between.

As mentioned above, in an example a magnitude of the second vector 40 of the pushing force 42 is at least 25% of a magnitude of the first vector 38 of the pushing force 42. As a result, the at least two leading surface portions 18*a*, 18*b* provide a stretching of the skin such that the degree of skin stretching in the direction X perpendicular to the main movement direction 26 is at least 25% of the degree of skin stretching in the direction Y parallel to the main movement direction. In other words, sideward stretching is provided at least to such a degree that the skin is stretched notably in the direction Y perpendicular to the main movement direction 26.

In another example, the magnitude of the second vector 40 of the pushing force 42 is larger than the magnitude of the first vector 38 of the pushing force 42, so that the stretching of the skin in the direction X perpendicular to the main movement direction 26 is provided such that it exceeds the stretching of the skin in the direction Y parallel to main movement direction 26. In other words, there is provided more stretching to the sides than to the front.

In another example, the stretching of the skin in the main movement direction is provided to a larger degree than the stretching of the skin in the direction perpendicular to the main movement direction.

In a still further example, the stretching of the skin in the main movement direction is provided to a similar degree as the stretching of the skin in the direction perpendicular to the main movement direction.

An example is provided in which the stretching effect on the skin in front of the hair removal device takes place at an angle of approximately 45°.

In said other example mentioned above, where the stretching in the direction perpendicular to the main movement direction is provided to a larger degree, the skin is stretched mainly to the sides with respect to the main movement direction.

As optionally indicated in FIGS. 6A and 6B, the at least two leading surface portions 18*a*, 18*b* are provided with a surface structure having ridges 54 that are provided at an inclined angle with respect to the main movement direction 26, and/or at an inclined angle with respect to the main direction of extension of the leading surface portions. The ridges 54 provide and support the pushing effect on the skin.

In a further example, the at least two leading surface portions 18*a*, 18*b* are provided with a flexible surface 56 having a flexible surface material which is able to provide a water dissipating effect when moving along the skin surface.

Figure 8:
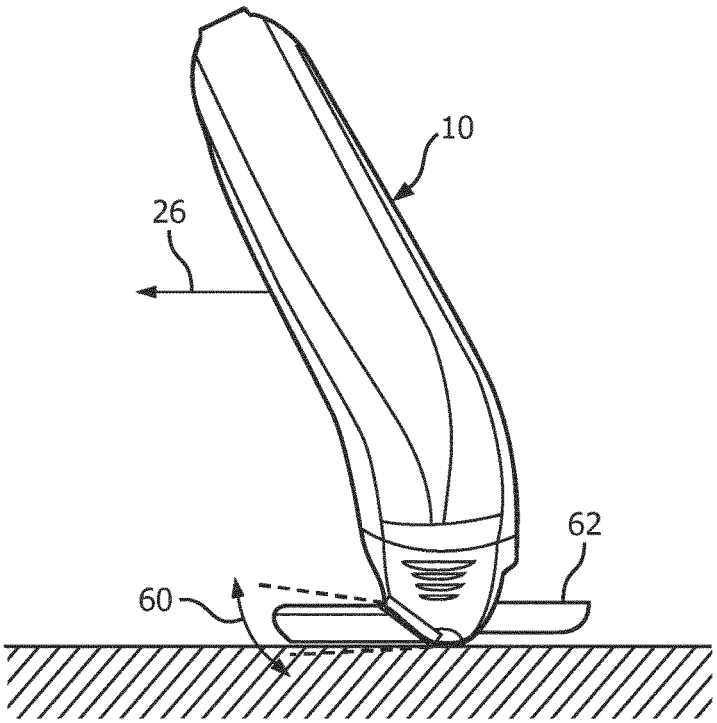
FIG. 8 shows a further example of the handheld hair removal apparatus according to the invention.

In a further example, the at least two leading surface portions are provided in a resilient manner, as indicated by means of a double arrow 60 in FIG. 8. The resiliency with respect to the support structure is provided to allow skin contact with distributed contact pressure.

Said skin contact may be provided with distributed contact pressure. In an example, the skin stretching device, e.g. the leading surface portions, are provided with a spring loaded support. In a further example, additionally or alternatively, the skin stretching device is provided with a flexible, i.e. resilient, frame structure.

In an example, the at least two leading surface portions are supported by a flexible connection, such as a hinge or joint (not further shown).

By designing the at least two leading surface portions so as to be movable, it is achieved that the skin-stretching part can be in conformity with the skin's surface structure, or three-dimensional profile of the skin. The at least two leading surface portions can hence abut the skin in a comfortable way.

In an example, at least one further skin touching portion is provided on a side opposite the skin contact portion, i.e. behind the portion where hairs are removed. For example, the further skin touching portion may be provided as two segments 62 serving as sliding support surfaces allowing the apparatus to be manually set to the preferred angle. The further skin touching portions may be provided in the form of ski portions for allowing the sliding support. The further skin touching portions may be provided with a flexible connection to the support structure or housing, such as a flexible hinge or joint.

In a further example, as optionally indicated in FIG. 1, the at least two leading surface portions bound an area 64 of the skin as a working area, in which the skin is stretched for hair removal following skin stretching.

In a further example, a light 66 is provided to illuminate at least a portion of the skin present in the working area 64. For example, the light 66 can be integrated in the leading surface portions (not further shown in FIG. 1).

As indicated above, the hair removal arrangement 12 comprises a hair removal component, such as the epilating cylinder, with a longitudinal axis extending parallel to the primary axis 32. The main movement direction 26 of the apparatus is perpendicular to the longitudinal axis of the hair removal component. The hair removal arrangement may be an epilator, a shaver or a trimmer, as indicated above.

In an epilator, the hair removal component is an epilating cylinder which is rotatable about the longitudinal axis and which has a number of hair clamping members for catching and clamping hairs and pulling them out of the skin.

In a shaver, the hair removal component is a shaving head with at least one hair cutting member.

In a further example, viewed in a direction perpendicular to the main movement direction 26 and parallel to the primary axis 32, the hair removal arrangement has a first length 70 and the at least two leading surface portions 18*a*, 18*b* each have a second length 68*a*, 68*b* which is at least 20% of the first length 70 of the hair removal arrangement. This is indicated in FIG. 6*b* where the two leading surface portions 18*a*, 18*b* each extend in the direction parallel to the primary axis 32 over a respective distance, indicated by means of references 68*a* and 68*b*, and the (not shown) epilator cylinder (or roll) extends in the direction parallel to the primary axis 32 over a distance, indicated by means of reference 70. In another example, the ratio between each of the lengths 68*a*, 68*b* and the length 70 amounts to at least 30%, e.g. 40%, or 50% or 60% or 70% or another value.

As indicated above, according to an aspect, stretching of the skin in a direction perpendicular to the main movement direction is achieved as a result of a specific boat-like or hull-like shape of the skin stretcher, which pushes the skin aside. Said sideways stretching of the skin can be increased by providing the skin stretcher with ridges extending at an angle with respect to the main movement direction. By stretching the skin in the direction perpendicular to the main movement direction, the skin is not only pushed forward in the main movement direction in front of the hair removal device, but is pushed mainly to the sides.

By providing a stretching arrangement, it is no longer necessary to stretch skin manually, which may be not easy to do and which is uncomfortable for the user.

As indicated above, flexible materials can be used to increase friction and to dissipate water in wet use. For example, these materials may be composed of rubbers, elastomers, foam plastics and the like. The skin stretcher can flex as a whole or in specific places when use is made of rubber-like materials, thus enabling it to follow the contours of the body. Due to the skin stretching arrangement, for example in the form of a closed bow-like structure, said perpendicular skin stretching results in stretching the skin continuously regardless of the length of the hair removal stroke.

As a further parameter to influence the stretching of the skin, different surface textures for a skin stretcher can be provided. For example, a rough texture provides more grip on hairs and small unevennesses of the skin.

As indicated above, the skin stretcher tautens the skin. It is further noted that taut skin is significantly less painful to epilate, for example, because the skin elasticity is decreased, thereby decreasing the deformation of the skin where the nerves are located. Taut skin is less prone to skin doming. Skin contact with a cutting element, such as a trimmer, rotary shaver, or foil shaver, etc., is prevented and sharp elements are less likely to scratch the skin. Further, flat lying hairs may be a common nuisance, and they are difficult to epilate, because they are difficult to catch. The skin stretcher according to the present invention lifts the hairs by moving the skin stretching portion against the grain of the hair, folding the flat hair backwards after which it resurrects to be epilated or cut. This further increases efficiency and thus also reduces pain and skin damage, since fewer strokes are necessary to obtain the desired result.

It has to be noted that embodiments of the invention are described with reference to different subject matters. However, a person skilled in the art will gather from the above and the following description that, unless otherwise notified, in addition to any combination of features belonging to one type of subject matter also any combination of features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A handheld hair removal apparatus, comprising: a head portion detachably mountable to a support structure; a hair removal arrangement provided in the head portion; the support structure configured to detachably support the hair removal arrangement; the hair removal arrangement comprising a skin contact portion for contacting a user's skin during operation, said skin contact portion extending at least along a primary axis extending perpendicularly to a main movement direction in which the apparatus is to be moved relative to skin during use; a plurality of skin stretching devices that are detachably mounted to the support structure and that comprises at least two leading surface portions for skin contacting and stretching, wherein the at least two leading surface portions are each attached to the support structure, each leading surface portion extending in a substantially vertical direction from the support structure, each leading surface portion being in the shape of one-half of an elongate arch to form one-half of a v-shaped bow structure, each leading surface portion meeting at an apex coincident with a midline of an arch of said bow structure to form a closed front portion, wherein the at least two leading surface portions are each provided with a skin touching surface portion, wherein the plurality of skin stretching devices differ in at least one of size, shape and material; wherein the at least two leading surface portions are attached to the support structure in a movable manner thereby allowing relative bending movement of the at least two leading surface portions with respect to the support structure at least in a direction of a skin contact pressure, wherein the movable manner allows at least a small degree of bending substantially in the range of 10 to 15, wherein the degree of bending is dependent upon a pressure applied by a user, the at least two leading surface portions seen in an imaginary plane comprising a base line and extending parallel to the main movement direction, are arranged at opposite inclinations of at least 20 with the base line, wherein the base line is a line perpendicular to the main movement direction and parallel to the primary axis, wherein each of the skin touching surface portions, seen in said imaginary plane, has a main direction of extension that is inclined with respect to the base line at an angle of at least 20, and wherein, in the main movement direction, the leading surface portions are oriented towards each other; wherein, in an operational position, the skin stretching device is arranged in front of the skin contact portion at an inclined angle with respect to the main movement direction, and wherein the at least two leading surface portions are configured and arranged to be brought into contact with the skin, during operation, to act on the skin with a pushing force having a first vector, parallel to the skin's surface, in a first direction (Y) parallel to the main movement direction, and a second vector, parallel to the skin's surface, in a second direction (X) perpendicular to the main movement direction, wherein the pushing force acts on the skin to provide a stretched skin portion between the at least two leading surface portions.

2. The apparatus according to claim 1, wherein the at least two leading surface portions are provided with a convex structure with respect to their outer shape facing forward in the main movement direction.

3. The apparatus according to claim 1, wherein each of the at least two leading surface portions are provided with a surface structure that is provided with a raised front portion with respect to the main movement direction, wherein the front portions are provided as a distal tip portion extending along approximately 5% to 50% of the extension of the leading surface portions.

4. The apparatus according to claim 1, wherein a magnitude of the second vector of the pushing force is at least 25% of a magnitude of the first vector of the pushing force.

5. The apparatus according to claim 1, wherein the at least two leading surface portions are provided with a surface structure having a series of substantially vertically parallel elongate linear shaped ridges of varying lengths that are provided:

at an inclined angle with respect to the main movement direction; and/or at an inclined angle with respect to a main direction of extension of the respective leading surface portions.

6. The apparatus according to claim 1, wherein the at least two leading surface portions are provided with a flexible surface material able to provide a water-dissipating effect when said leading surface portions move along the skin surface.

7. The apparatus according to claim 1, wherein the at least two leading surface portions are provided in a resilient manner with respect to the support structure to allow skin contact with distributed contact pressure; and wherein the at least two leading surface portions are attached to the support structure in a movable manner allowing relative movement of the at least two leading surface portions with respect to the support structure at least in a direction of the contact pressure.

8. The apparatus according to claim 1, wherein the at least two leading surface portions bound an area of the skin as a working area, in which the skin is stretched in preparation for hair removal following the stretching of the skin.

9. The apparatus according to claim 8, wherein a light is provided to illuminate at least a portion of the skin present in said working area.

10. The apparatus according to claim 1, wherein the hair removal arrangement comprises a hair removal component with a longitudinal axis extending perpendicularly to the main movement direction.

11. The apparatus according to claim 1, wherein the at least two leading surface portions are provided with a surface structure having ridges that are provided:

at an inclined angle with respect to the main movement direction; and/or at an inclined angle with respect to a main direction of extension of the respective leading surface portions.

12. A handheld hair removal apparatus, comprising: a head portion detachably mountable to a support structure; a hair removal arrangement provided in the head portion; the support structure configured to detachably support the hair removal arrangement; the hair removal arrangement comprising a skin contact portion for contacting a user's skin during operation, said skin contact portion extending at least along a primary axis extending perpendicularly to a main movement direction in which the apparatus is to be moved relative to skin during use; a plurality of skin stretching devices that are detachably mounted to the support structure and that comprises at least two leading surface portions for skin contacting and stretching, wherein the at least two leading surface portions are each attached to the support structure, each leading surface portion extending in a substantially vertical direction from the support structure, each leading surface portion being in the shape of one-half of an elongate arch to form one-half of a v-shaped bow structure, each leading surface portion being inclined towards an apex coincident with a midline of an arch of said bow structure to form an open front portion having a separation distance therebetween, wherein the at least two leading surface portions are each provided with a skin touching surface portion, wherein the plurality of skin stretching devices differ in at least one of size, shape and material; wherein the at least two leading surface portions are attached to the support structure in a movable manner thereby allowing relative bending movement of the at least two leading surface portions with respect to the support structure at least in a direction of a skin contact pressure, wherein the movable manner allows at least a small degree of bending substantially in the range of 10 to 15, wherein the degree of bending is dependent upon a pressure applied by a user, the at least two leading surface portions seen in an imaginary plane comprising a base line and extending parallel to the main movement direction, are arranged at opposite inclinations of at least 20 with the base line, wherein the base line is a line perpendicular to the main movement direction and parallel to the primary axis, wherein each of the skin touching surface portions, seen in said imaginary plane, has a main direction of extension that is inclined with respect to the base line at an angle of at least 20, and wherein, in the main movement direction, the leading surface portions are oriented towards each other; wherein, in an operational position, the skin stretching device is arranged in front of the skin contact portion at an inclined angle with respect to the main movement direction, and wherein the at least two leading surface portions are configured and arranged to be brought into contact with the skin, during operation, to act on the skin with a pushing force having a first vector, parallel to the skin's surface, in a first direction (Y) parallel to the main movement direction, and a second vector, parallel to the skin's surface, in a second direction (X) perpendicular to the main movement direction, wherein the pushing force acts on the skin to provide a stretched skin portion between the at least two leading surface portions.

13. The apparatus according to claim 12, wherein, viewed in a direction parallel to the primary axis, the hair removal arrangement has a first length corresponding to the separation distance between a point on a first leading surface portion and a corresponding point on a second leading surface portion, and the at least two leading surface portions each have a second length which is at least 20% of said first length of the hair removal arrangement.

14. A shaver, comprising: a head portion detachable mountable to a support structure; a hair removal arrangement provided in the head portion, the support structure configured to detachably support the hair removal arrangement; the hair removal arrangement comprising a shaving head with at least one hair cutting member, the arrangement having a longitudinal axis extending perpendicularly to the main movement direction; the hair removal arrangement further comprising a skin contact portion for contacting a user's skin during operation, said skin contact portion extending at least along a primary axis perpendicular to a main movement direction in which the apparatus is to be moved relative to skin during use; a plurality of skin stretching devices that are detachably mounted to the support structure and that comprises at least two leading surface portions for skin contacting and stretching, wherein the at least two leading surface portions are each attached to the support structure, each leading surface portion extending in a substantially vertical direction from the support structure, each leading surface portion being in the shape of one-half of an elongate arch to form one-half of a v-shaped bow structure, each leading surface portion meeting at an apex coincident with a midline of an arch of said bow structure to form a closed front portion, wherein the at least two leading surface portions are each provided with a skin touching surface portion, wherein the plurality of skin stretching devices differ in at least one of size, shape and material; wherein the at least two leading surface portions are attached to the support structure in a movable manner thereby allowing relative bending movement of the at least two leading surface portions with respect to the support structure at least in a direction of a skin contact pressure, wherein the movable manner allows at least a small degree of bending substantially in the range of 10 to 15, wherein the degree of bending is dependent upon a pressure applied by a user, the at least two leading surface portions seen in an imaginary plane comprising a base line and extending parallel to the main movement direction, are arranged at opposite inclinations of at least 20 with the base line, wherein the base line is a line perpendicular to the main movement direction and parallel to the primary axis, wherein each of the skin touching surface portions, seen in said imaginary plane, has a main direction of extension that is inclined with respect to the base line at an angle of at least 20, and wherein, in the main movement direction, the leading surface portions are oriented towards each other; wherein, in an operational position, the skin stretching device is arranged in front of the skin contact portion at an inclined angle with respect to the main movement direction, and wherein the at least two leading surface portions are configured and arranged to be brought into contact with the skin, during operation, to act on the skin with a pushing force having a first vector, parallel to the skin's surface, in a first direction (Y) parallel to the main movement direction, and a second vector, parallel to the skin's surface, in a second direction (X) perpendicular to the main movement direction, wherein the pushing force acts on the skin to provide a stretched skin portion between the at least two leading surface portions.

15. The shaver according to claim 14, wherein the at least two leading surface portions are provided with a surface structure having ridges that are provided:

at an inclined angle with respect to the main movement direction; and/or at an inclined angle with respect to a main direction of extension of the respective leading surface portions.

16. An epilator, comprising: a head portion detachable mountable to a support structure; a hair removal arrangement provided in the head portion, the support structure configured to detachably support the hair removal arrangement; the hair removal arrangement comprising an epilating cylinder which is rotatable about the longitudinal axis and which has a number of hair clamping members for catching and clamping hairs and pulling them out of the skin; the hair removal arrangement further comprising a skin contact portion for contacting a user's skin during operation, said skin contact portion extending at least along a primary axis perpendicular to a main movement direction in which the apparatus is to be moved relative to skin during use; a plurality of skin stretching devices that are detachably mounted to the support structure and that comprises at least two leading surface portions for skin contacting and stretching, wherein the at least two leading surface portions are each attached to the support structure, each leading surface portion extending in a substantially vertical direction from the support structure, each leading surface portion being in the shape of one-half of an elongate arch to form one-half of a v-shaped bow structure, each leading surface portion meeting at an apex coincident with a midline of an arch of said bow structure to form a closed front portion, wherein the at least two leading surface portions are each provided with a skin touching surface portion, wherein the plurality of skin stretching devices differ in at least one of size, shape and material; wherein the at least two leading surface portions are attached to the support structure in a movable manner thereby allowing relative bending movement of the at least two leading surface portions with respect to the support structure at least in a direction of a skin contact pressure, wherein the movable manner allows at least a small degree of bending substantially in the range of 10 to 15, wherein the degree of bending is dependent upon a pressure applied by a user, the at least two leading surface portions seen in an imaginary plane comprising a base line and extending parallel to the main movement direction, are arranged at opposite inclinations of at least 20 with the base line, wherein the base line is a line perpendicular to the main movement direction and parallel to the primary axis, wherein each of the skin touching surface portions, seen in said imaginary plane, has a main direction of extension that is inclined with respect to the base line at an angle of at least 20, and wherein, in the main movement direction, the leading surface portions are oriented towards each other; wherein, in an operational position, the skin stretching device is arranged in front of the skin contact portion at an inclined angle with respect to the main movement direction, and wherein the at least two leading surface portions are configured and arranged to be brought into contact with the skin, during operation, to act on the skin with a pushing force having a first vector, parallel to the skin's surface, in a first direction (Y) parallel to the main movement direction, and a second vector, parallel to the skin's surface, in a second direction (X) perpendicular to the main movement direction, wherein the pushing force acts on the skin to provide a stretched skin portion between the at least two leading surface portions.

17. The epilator according to claim 16, wherein the at least two leading surface portions are provided with a surface structure having ridges that are provided:

at an inclined angle with respect to the main movement direction; and/or at an inclined angle with respect to a main direction of extension of the respective leading surface portions.

* * * * *